US006451028B1

(12) United States Patent
Sanchez-Martinez et al.

(10) Patent No.: US 6,451,028 B1
(45) Date of Patent: Sep. 17, 2002

(54) ROTATING CYLINDER FOR AN EPILATOR

(75) Inventors: Pedro Sanchez-Martinez, Kronberg; Christof Ungemach, Frankfurt, both of (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/673,523

(22) PCT Filed: May 25, 1999

(86) PCT No.: PCT/EP99/03579

§ 371 (c)(1),
(2), (4) Date: Oct. 17, 2000

(87) PCT Pub. No.: WO99/60883

PCT Pub. Date: Dec. 1, 1999

(30) Foreign Application Priority Data

May 27, 1998 (DE) ..... 198 23 577

(51) Int. Cl.[7] ..... A61B 17/50
(52) U.S. Cl. ..... 606/133; 452/82
(58) Field of Search ..... 606/1, 131, 133; 452/82–85

(56) References Cited

U.S. PATENT DOCUMENTS 5,108,410 A * 4/1992 Iwasaki et al.
5,234,472 A * 8/1993 Schäfer et al. ..... 606/133
5,449,364 A * 9/1995 Niedertschfider et al. ... 606/133
5,857,903 A * 1/1999 Ramspeck et al.

FOREIGN PATENT DOCUMENTS

| | | |
|---|---|---|
| DE | 43 34 850 C2 | 10/1995 |
| DE | 44 27 788 A1 | 2/1996 |
| EP | 0 585 621 A1 | 3/1994 |
| FR | 2 680 651 | 3/1993 |
| FR | 2 703 885 | 10/1994 |
| JP | 06105712 | 4/1994 |
| WO | WO 91/03964 | 4/1991 |
| WO | WO 98/05234 | 2/1998 |

* cited by examiner

*Primary Examiner*—Kevin Shaver
*Assistant Examiner*—Pamela Lynn Wingood
(74) *Attorney, Agent, or Firm*—Fish & Richardson P.C.

(57) ABSTRACT

The invention is directed to a rotary cylinder for an epilation appliance which in a preferred embodiment has at least two adjacent disks (1, 1') provided on their facing sides with at least one groove (2) to form a clamping element receiving space (3). Provision is made for two clamping elements (5, 6) arranged adjacent to each other which are accomodated in the clamping element receiving space (3). Noise damping mechanisms are provided which are associated with at least one of the clamping elements (5, 6).

19 Claims, 6 Drawing Sheets

ROTATING CYLINDER FOR AN EPILATOR

Figure 1A:
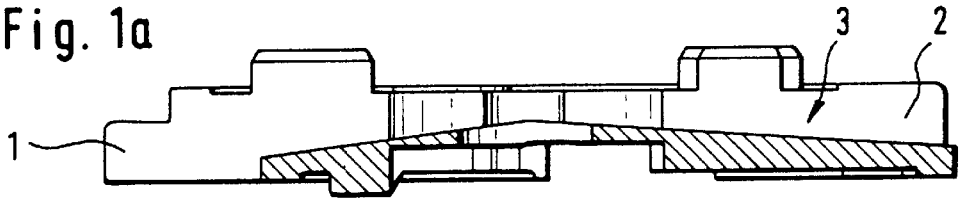

This invention relates to a rotary cylinder or a rotary drum for an epilating appliance, having at least two clamping elements arranged adjacent to each other.

From international patent application PCT/EP96/04915 there is known an epilating appliance equipped with a rotary cylinder having a multiplicity of clamping element pairs which are offset at an angle to each other. With the aid of pressure pins the clamping elements are moved during rotation of the rotary cylinder so that in the area of a plucking zone they are brought pair by pair into clamping contact. Any of the user's hairs lying between the clamping elements will be plucked by the further rotary movement of the rotary cylinder.

It is desirable for at least one of the clamping elements to be made of a hard material such as metal in order for the hairs to be reliably gripped and extracted. This may result in a metallic noise occurring when the two clamping elements strike each other. The use of a softer and hence quieter material is not readily possible because then reliable gripping of the hairs would no longer be guaranteed.

It is an object of the present invention to provide a rotary cylinder for an epilating appliance which is efficient and quiet as regards the removal of hairs, developing in particular less noise than conventional rotary cylinders while still enabling the reliable gripping and plucking of hairs.

According to the present invention this object is accomplished with a rotary cylinder of the type initially referred to by providing mechanisms for damping the noise which are associated with at least one of the clamping elements.

In an advantageous aspect of the present invention provision is made for an intermediate layer between one of the two disks and the adjacent clamping element or between the adjacent clamping elements themselves. The resulting reduction of noise is based on the joint damping effect, according to which the micro movements occurring in a vibratory system in joints, that is, in the area of component interfaces, are converted by friction into heat (Coulomb's friction) and severely damped in the process.

Preferably the rotary cylinder is provided with at least two adjacent disks having on their facing sides a groove for forming a clamping element receiving space in which at least one clamping element is arranged.

In a further advantageous variant the intermediate layer is constructed as a component of the clamping element on the clamping element's side close to the disk. This may be accomplished, for example, by the clamping element being roughened, the roughened layer then forming the intermediate layer.

In yet another advantageous variant the intermediate layer is constructed as a shim. It is thus possible to adapt the intermediate layer to the clamping elements with a view to achieving an optimal noise reduction. In particular the shim can be specifically selected and constructed as regards its material and size.

In both variants, at least one of the two facing clamping elements is movable, with the intermediate layer being associated in particular with the movable clamping element.

In this arrangement it is particularly advantageous for the production process to allow for a clearance in the clamping element receiving space between the disk and the movable clamping element and for the clearance to be filled by the intermediate layer. In other words, a clearance already existing for production reasons between the disk and the movable clamping element is used to position the intermediate layer there. No technical changes need to be made therefore to the rotary cylinder, and even former rotary cylinders can be readily equipped with the intermediate layer of the invention.

It is also an advantage for the intermediate layer to be of an elastic construction. Particularly the movable clamping element will not be obstructed therefore in its free mobility when the intermediate layer is inserted.

Among other materials, paper and/or sand paper and/or plastic and/or sponge rubber and/or the like have proven practical as the intermediate layer.

In a further advantageous and separable embodiment of the invention, which can also be applied independently of using the intermediate layer, at least one of the two clamping elements has two outer laminations and at least one intermediate lamination in between. The clamping element thus has a type of sandwich structure, with the various laminations being firmly joined together. If the clamping element is incited to vibrate, the vibratory energy will be converted in the intermediate lamination into heat (via shear stresses), thus reducing vibrations and noise. Hence the clamping element produces less structure-borne noise and air-borne noise and the development of noise is reduced.

It is particularly advantageous for the intermediate lamination to include a polymer, in particular an adhesive. It is also particularly advantageous for the outer laminations to include a metal, in particular steel.

If noise reduction is the sole concern, a symmetrical design of the sandwich structure with identical thickness of the outer laminations will be preferred. However, it is also necessary to consider the clamping action of the sandwich structures, particularly with a view to their deflection. Hence in an advantageous further aspect of the invention the thickness of the outer laminations varies because this enables the clamping action to be optimized without substantially impairing the degree of noise reduction.

In a further advantageous, separable embodiment of the invention, which can also be applied independently of using the intermediate layer or the sandwich structure, the at least one clamping element is adapted to be acted upon by two pressure pins, with the noise damping mechanisms being associated with the pressure pins. A particularly effective and extensive damping of the noise can be achieved by associating the noise reduction mechanisms with the pressure pins. This noise damping can be performed as an alternative or addition to the noise damping measures previously referred to. Hence it is possible on the whole to achieve an extensive reduction of noise in return for only a small additional outlay.

It is particularly advantageous for the two pressure pins to be actuatable by a thrust plate and for the noise reduction mechanisms to be arranged between the pressure pins and the thrust plate. This arrangement is particularly well suited as an additional measure to the noise damping measures previously described.

In an advantageous further aspect of the present invention a damping disk is provided as a noise reduction mechanism. This damping disk requires only a small outlay to achieve the reduction of noise in accordance with the invention.

Conveniently, in this arrangement the damping disk is made of a metal, in particular of a spring steel, or of a plastics material, in particular a flexible plastics material.

Further features, application possibilities and advantages of the present invention will become apparent from the subsequent description of embodiments of the invention presented in the Figures of the accompanying drawings. It will be understood that all the described or illustrated features, whether singly or in any combination, represent the subject-matter of the present invention irrespective of their summary in the patent claims or their back references and irrespective of their wording and presentation in the description and the drawings, respectively. In the drawings, FIG. 1*a* is a schematic sectional view of an embodiment of a disk of a rotary cylinder of the present invention for an epilating appliance, taken along the plane I of FIG. 1*b;*

Figure 1B:
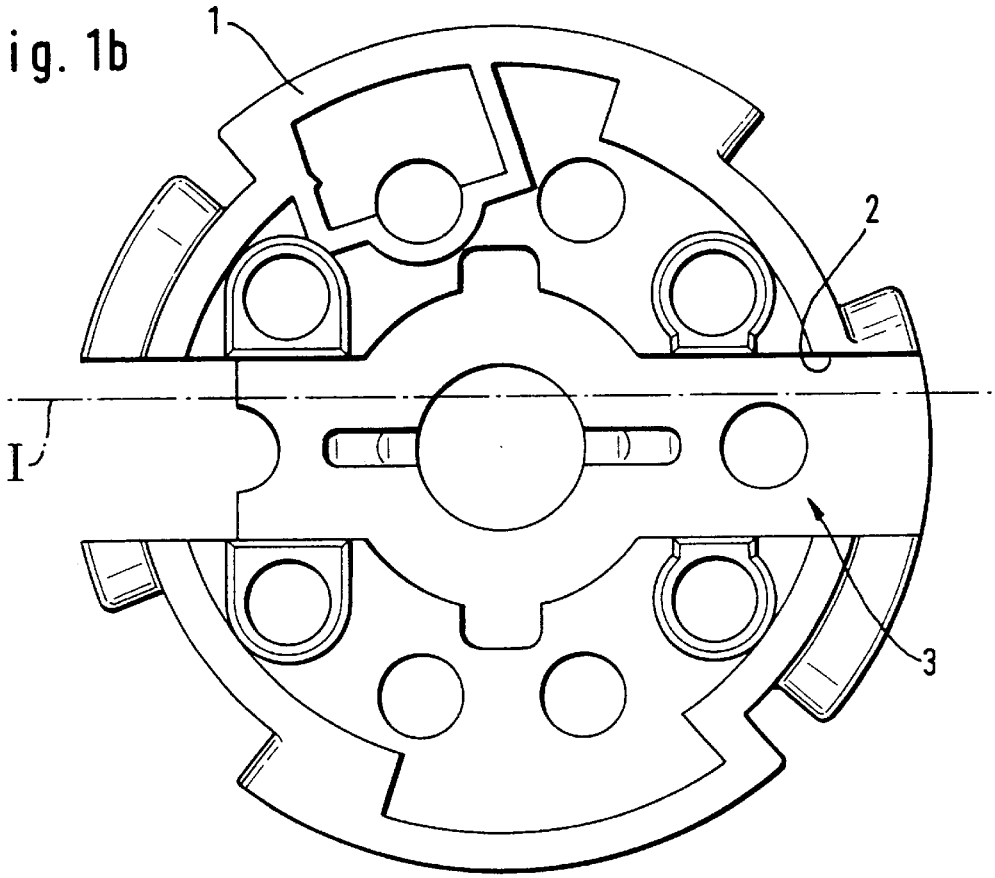

FIG. 1*b* is a schematic top plan view of the disk of FIG. 1*a;*

Figure 2:
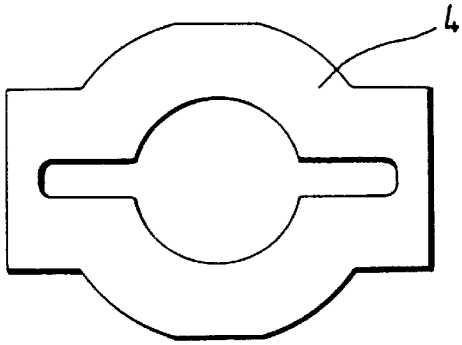

FIG. 2 is a schematic top plan view of a shim of the invention for the disk of FIGS. 1*a* and 1*b;*

Figure 3A:
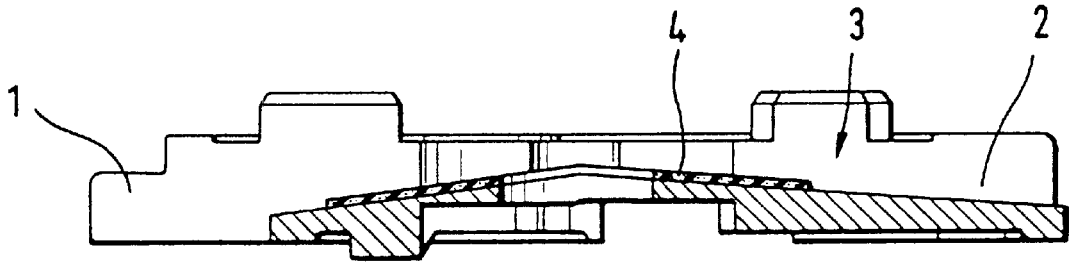
Figure 3B:
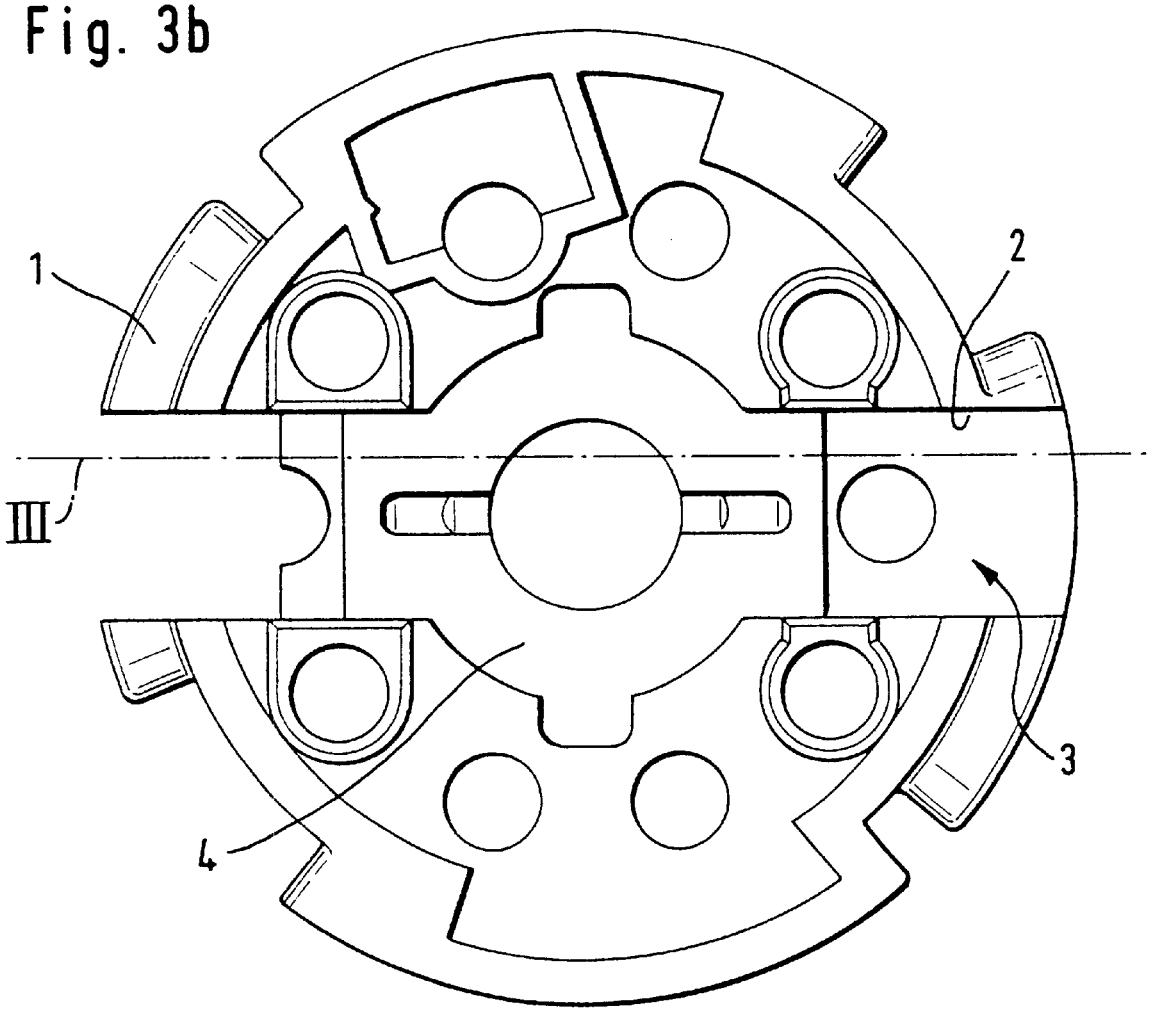

FIG. 3*a* is a schematic sectional view of the disk of FIGS. 1*a* and 1*b* and the inserted shim of FIG. 2, taken along the plane III of FIG. 3*b;*

FIG. 3*b* is a schematic top plan view of disk and the inserted shim of FIG. 3*a;*

Figure 4:
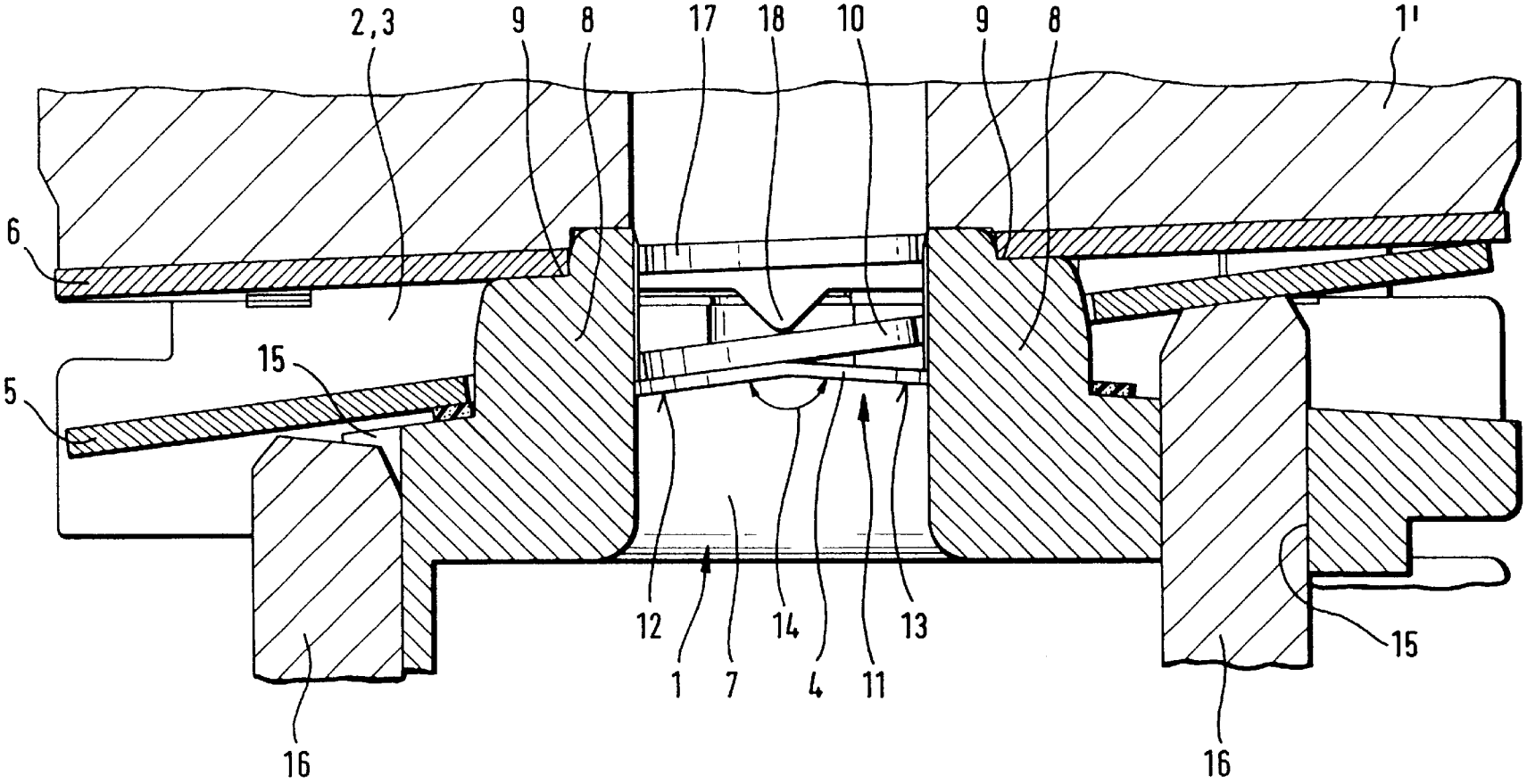
Figure 5A:
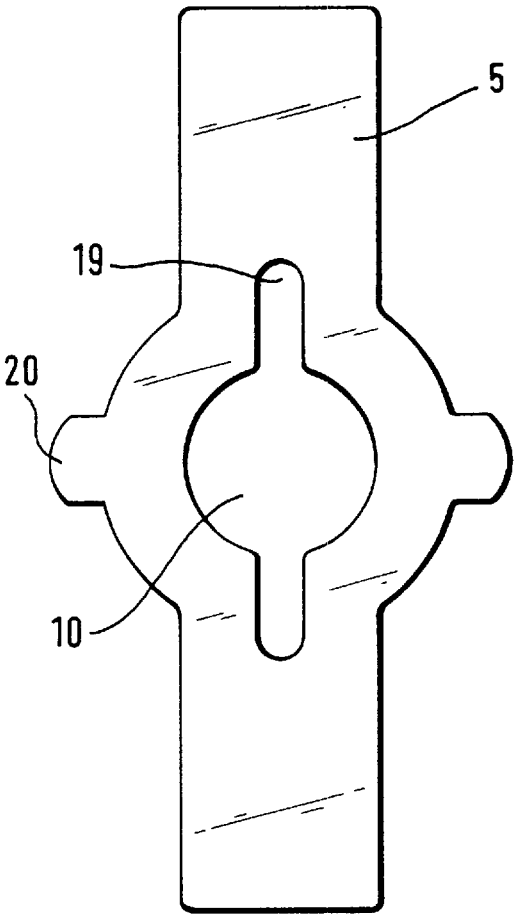
Figure 5B:
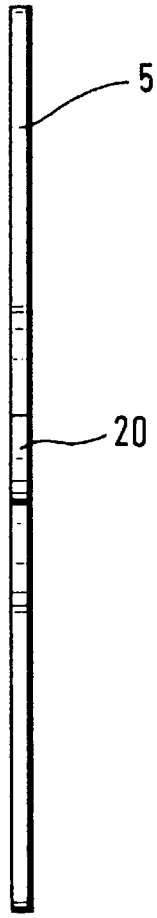

FIG. 4 is a schematic sectional view, on an enlarged scale, of the disk of FIGS. 1*a* and 1*b* and the inserted shim of FIG. 2, showing also the actuating mechanism;

FIG. 5*a* is a schematic top plan view of a clamping element for the rotary cylinder according to an embodiment of the present invention;

FIG. 5*b* is a schematic side view of the clamping element of FIG. 5*a;*

Figure 5C:
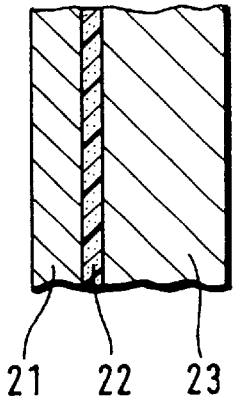
Figure 6:
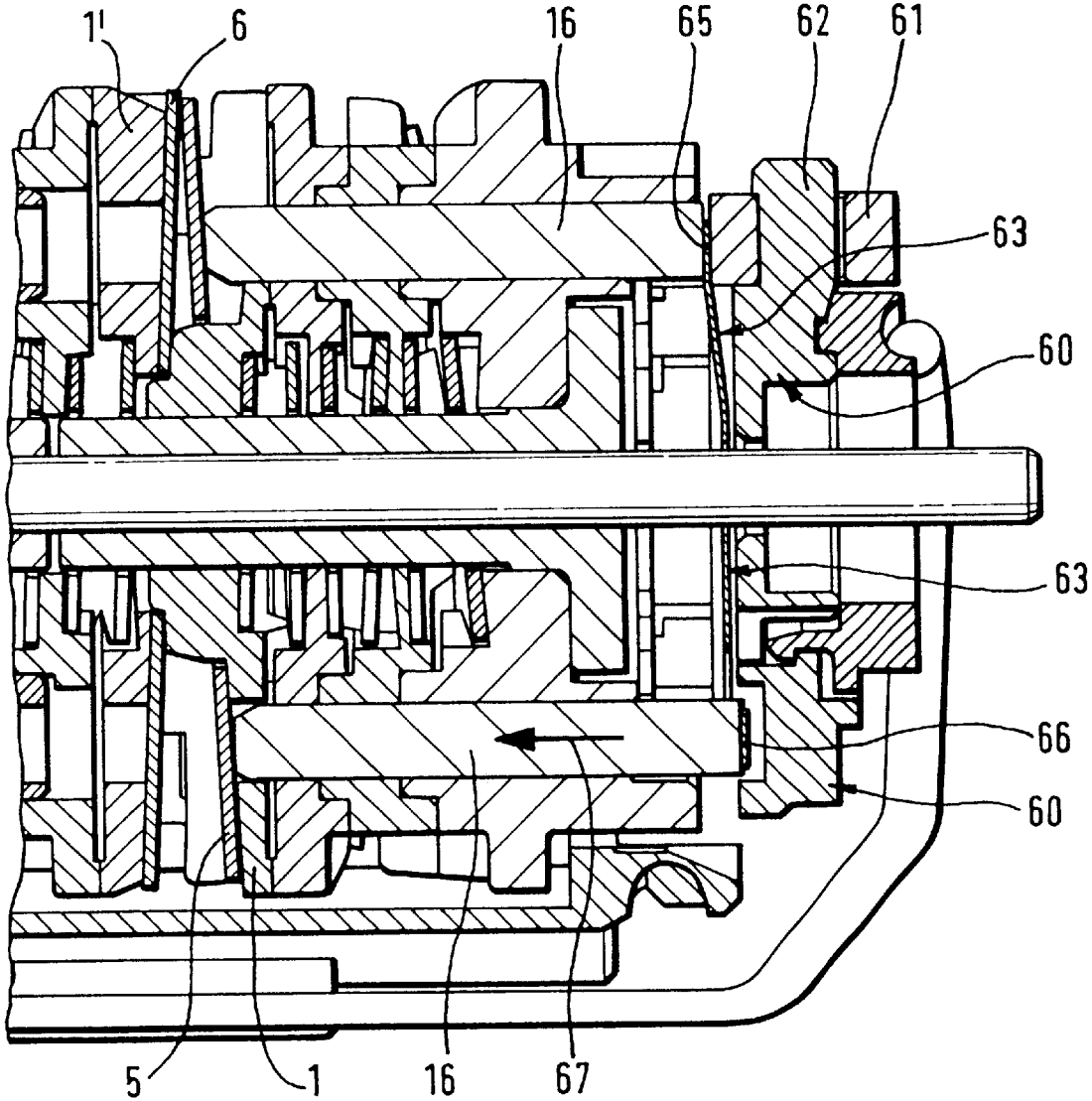
Figure 7:
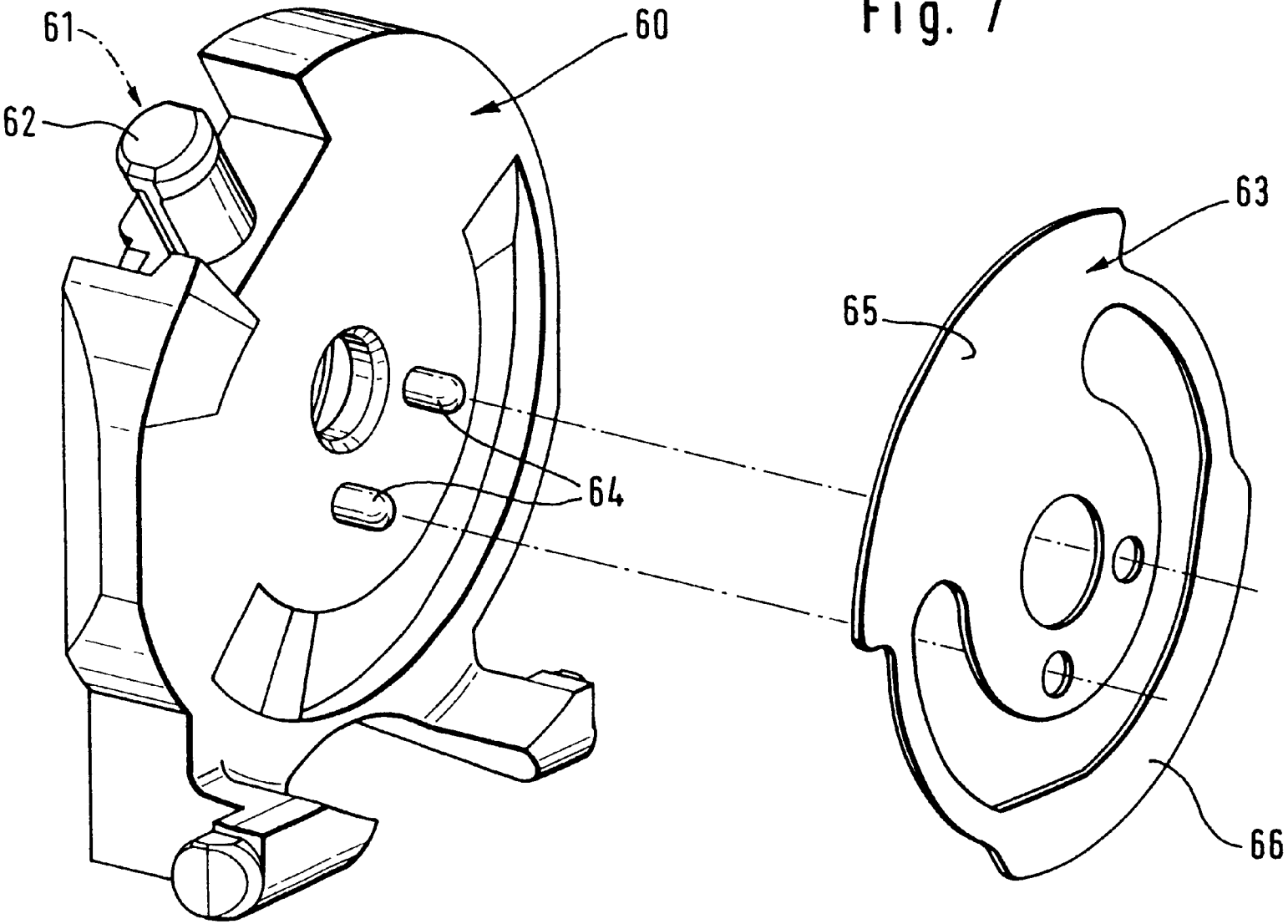

FIG. 5*c* a schematic side view of the clamping element of FIG. 5*a* on an enlarged scale;

FIG. 6 is a schematic sectional view of the rotary cylinder with a thrust plate; and FIG. 7 is a schematic perspective view of the thrust plate of FIG. 6 with an associated damping disk.

A rotary cylinder for an epilating appliance is described in international patent application PCT/EP 96/04915, which shall be deemed to be incorporated in the disclosure content of the present patent application by express reference. In this application the term "rotary cylinder" is used to denote a part which can also have drum-shaped, curved or concave or convex structures. Furthermore, the term "rotary cylinder" is used not only for a continuous rotation but also for an oscillatory pivot movement or partial rotation of the cylinder or the like.

The rotary cylinder has a multiplicity of disks 1 arranged in a roughly coaxial and adjacent relationship to one another. Provided in each of the facing surfaces of the disks 1 is a groove 2 extending roughly crosswise over the surface and approximately through the centerpoint of the respective disk 1. The grooves 2 of facing adjacent disks 1 are in such relative arrangement as to produce an elongate clamping element receiving space 3 with a roughly rectangular cross section.

Accommodated in the clamping element receiving space 3 are two clamping elements extending over the full length of the clamping element receiving space 3 and having approximately the same width as it. The clamping elements are made of metal and are constructed like leaf springs. The clamping elements are inserted in the grooves 2 and arranged roughly parallel to each other in terms of their main plane of extension. The two clamping elements face each other and form a pair of clamping elements. The two adjacent clamping elements are partly in abutting relationship with each other.

FIGS. 1*a* and 1*b* show one of the disks 1 with one of the grooves 2 and the thus formed clamping element receiving space 3. The clamping elements are not shown in FIGS. 1*a* and 1*b*.

FIG. 2 shows a shim 4 which can be made of normal paper and/or sand or abrasive paper with a particularly fine grain and/or a plastic film and/or a sponge-rubber-like material. The shim 4 is of a flat construction and has the shape of the grooves 2 or the clamping element receiving space 3.

FIGS. 3*a* and 3*b* show the disk 1 with the groove 2 and the thus formed clamping element receiving space 3. The shim 4 is shown inserted in the clamping element receiving space 3. The clamping elements are not shown in FIGS. 3*a* and 3*b*.

FIG. 4 also shows the disk 1 with the groove 2 and the thus formed clamping element receiving space 3. The shim 4 is shown inserted in the clamping element receiving space 3. Also shown in FIG. 4 is a movable clamping element 5 and a stationary clamping element 6. In FIG. 4 the next, adjacent disk 1' is plugged on the disk 1.

The two clamping elements 5, 6 are arranged so as to face each other, each having roughly the dimensions of the clamping element receiving space 3 and a flat, in particular leaf-spring-like construction. The clamping elements 5, 6 are made of steel, for example.

The disk 1 has a central opening 7 through which an axle for the rotary cylinder can be pushed. Arranged on both sides of the opening 7 in the direction of the clamping element receiving space 3 is a projection 8, each equipped with one step 9.

The movable clamping element 5 is provided with a cutout 10, enabling the clamping element to be slipped over and past the projections 8. The movable clamping element 5 is laterally guided by the projections 8 so that it is unhindered in performing the tilting movement necessary for the clamping operation independently of the projections 8.

The disk 1 has a counter support 11 formed from two contiguous surfaces 12, 13 of the clamping element receiving space 3 which form an obtuse angle 14 with one another. The movable clamping element 5 engages either the one or the other of the two contiguous surfaces 12, 13, being hence pivotal about the obtuse angle 14.

The disk 1 is equipped with two openings 15, through which pressure pins 16 extend. The movable clamping element 5 can be pivoted to and from between the two positions identified with the aid of the pressure pins 16 and the rocker bearing or bearing 18.

The fixed clamping element 6 is placed on the steps 9 of the projections 8 of the disk 1 and has an opening 17 for the rotation axle of the rotary cylinder. The disk 1' is plugged on the disk 1 by means of the steps 9. The stationary clamping element 6 has its full surface in engagement with the disk 1'.

The disk 1' has a bearing 18 on the side close to the counter support 11. The beating 18 defines the rotation axis for the pivot movement of the free clamping element 5. When the movable clamping element 5 executes a pivot movement, the free end of said clamping element engages the free end of the stationary clamping element 6. The pressure pins 16 cause the movable clamping element 5 to be urged against the stationary clamping element 6, thereby securely clamping any hair lying in between.

The shim 4 is arranged between the movable clamping element 5 and the disk 1. Hence the movable clamping element 5 does not make direct engagement with the surfaces 12, 13 and therefore with the counter support 11, but only indirect engagement via the shim 4.

The shim 4 represents an intermediate layer associated with the movable clamping element 5. For production reasons there is a clearance of a few tenths of a millimeter between the movable clamping element 5 and the counter support 11. This clearance is advantageous for the free mobility of the movable clamping element 5. Said clearance is reduced by inserting the shim 4. The free mobility of the movable clamping element 5 is maintained, however, by selecting a suitable material for the shim 4, in particular by using a flexible construction for the shim 4, and by choosing a suitable thickness for the shim 4.

The number of joints between the components involved is doubled by the shim 4. Joints exist namely between the movable clamping element 5 and the shim 4 as well as between the shim 4 and the counter support 11. The movable clamping element 5 executes vibrations accompanied by micro movements. These micro movements are converted in the said joints into heat by friction (Coulomb's friction). The micro movements are thus damped. This amounts simultaneously to a damping of noise. Doubling the number of joints by using the shim 4 thus increases the joint damping effect previously described.

The joint damping effect has also been shown to reduce the high frequencies less agreeable to the human ear. This joint damping effect can also be enhanced by selecting a suitable material for the shim 4. A particularly rough surface of the shim 4 has proven in particular to be an advantage.

A further possibility is to also place a shim between the stationary clamping element 6 and the disk 1' and/or between the two clamping elements 5, 6, that is, in the area of the bearing 18 and the counter support 11.

Instead of using shims it is also possible to produce an intermediate layer by roughening the surface of the respective clamping element 5, 6. For example, the surface of the movable clamping element 5 on the side close to the disk 1 can be roughened, thus providing an intermediate layer as part of the clamping element 5 which enhances the joint damping effect in the same manner as the shim 4.

FIG. 5*a* illustrates the movable clamping element 5. The cutout 10 has an opening adapted for passage of the axle of the rotary cylinder therethrough. The movable clamping element 5 can be slipped over and past the projections 8 of the disk 1 in particular with the recesses 19. Also shown in FIG. 5 are lugs 20 with which the movable clamping element 5 rests against the bearing 18 of the disk 1'.

According to FIGS. 5*b* and 5*c* the movable clamping element 5 is composed of three laminations 21, 22, 23 which are firmly joined together. The two outer laminations 21, 23 are made of a metal, in particular steel. The two outer laminations can but do not have to differ in thickness. The intermediate lamination 22 in between is made of a polymer, in particular an adhesive.

The movable clamping element 5 shown in FIGS. 5*a*, 5*b* and 5*c* represents a compound vibration damping system associated with the movable clamping element 5. The said system is thus incorporated in one of those components providing the active force flow path in the rotary cylinder.

The movable clamping element 5 performs vibrations resulting in shear stresses in the intermediate lamination 22. The existing vibratory energy is thus converted in the intermediate lamination 22 into heat by shear stresses (internal friction). This causes the vibrations to be damped and hence the structure-borne noise and/or air-borne noise to be reduced. Less airborne noise is emitted and less structure-borne noise transmitted into adjacent parts of the housing from the movable clamping element 5. Similarly, less of the high-frequency air-borne noise disagreeable to the human ear is also emitted from the clamping element 5.

A further advantage of the movable clamping element 5 shown in FIGS. 5*a*, 5*b* and 5*c* is that the bounce of the clamping element 5 is also reduced. The closing action of the clamping elements 5, 6 is thus improved and a reliable gripping and plucking of hairs guaranteed.

Components in FIGS. 6 and 7, which were already explained in connection with FIGS. 1 to 5, are assigned the same references. With respect to these components, reference will thus be made to the description of FIGS. 1 to 5.

The noise damping mechanisms provided in FIGS. 1 to 5, for example the shim 4 or the like, can be provided likewise in FIGS. 6 and 7. It is also possible, however, for these mechanisms to be present only in part or to be omitted completely.

As in FIG. 4, the pressure pins 16 of FIGS. 6 and 7 are provided to act on the movable clamping element 5. One of the pressure pins 16 is associated with either of the free ends of the clamping element 5.

A thrust plate 60 is provided at both ends of the rotary cylinder. The thrust plate 60 serves the function of supporting the rotary cylinder and defines its rotation axis. The thrust plate 60 is therefore aligned coaxial to the disks 1, 1' and hence coaxial to the rotary cylinder. One end of the rotary cylinder with one of the two thrust plates 60 is shown in FIG. 6.

The thrust plate 60 is stationary in relation to the disks 1, 1' and hence in relation to the rotary cylinder. The thrust plate 60 is equipped with a pressure roller 61 having its rotation axis in radial alignment to the rotation axis of the rotary cylinder. FIG. 7 shows only the axle 62 of the pressure roller 61 and not the pressure roller 61 itself.

The pressure pins 16 accommodated in the rotary cylinder are actuated by means of the thrust plate 60. This is accomplished in that the pressure pins 16 move past the pressure roller 61 when the rotary cylinder rotates. As this passing movement occurs, the respective pressure pin 16 is urged by the pressure roller 61 toward the movable clamping element 5.

The two pressure pins 16 thus act upon the two free ends of the movable clamping element 5 in alternating sequence. As the result, the clamping element 5 is caused to pivot to and fro between its two limit positions. As this occurs, the clamping element 5 is invariably moved by one of the two pressure pins 16 at its one free end into one of the two limit positions, while the other pressure pin 16 is simultaneously urged back by the other free end of the clamping element 5.

A damping disk 63 is arranged between the thrust plate 60 and the pressure pins 16. The damping disk 63 is made of a metal, in particular a spring steel, or of a plastics material, in particular a flexible plastic or a plastic film.

The damping disk 63 is aligned coaxial to the thrust plate 60 and hence coaxial to the rotary cylinder. Centering pins 64 are provided to securely couple the damping disk 63 to the thrust plate 60, thus preventing the damping disk 63 from rotating about the rotation axis of the rotary cylinder.

The damping disk 63 has an area 65 which because of the centering pins 64 is invariably associated with the pressure roller 61, being positioned there between the pressure roller 61 and the respectively actuated pressure pin 61. Further, the damping disk 63 has an area 66 which because of the centering pins 64 is invariably associated with the pressure pin 16 which lies opposite the respectively actuated pressure pin 16 and is therefore associated with the same clamping element 5. This area 66 of the damping disk 63 is arranged between this opposite lying pressure pin 16 and the thrust plate 60.

The opposite lying pressure pin 16 is pushed back by the associated free end of the movable clamping element 5. In this position the pressure pin 16 is not loaded, however, by the thrust plate 60. Hence without the damping disk 63, the pressure pin 16 and hence the associated free end of the clamping element 5 can make uncontrolled movements and, under certain circumstances, be set in vibration.

The area 66 of the damping disk 63 is constructed so that the said opposite lying pressure pin 16 is loaded by the damping disk 63. Owing to this area 66 of the damping disk 63 lying in between, the pressure pin 16 is continuously urged against the free end of the clamping element 5. The pressure pin 16 is thus in continuous engagement with the free end of the clamping element 5. Neither the pressure pin 16 nor the associated free end of the clamping element 5 are able therefore to make uncontrolled movements or, still worse, execute a vibration.

This pressing action of the pressure pin 16 against the free end of the movable clamping element 5 accomplished by the area 66 of the damping disk 63 becomes apparent in particular from FIG. 6 where it is marked by an arrow 67.

Movement of the pressure pins 16 over the pressure roller 61 is also particularly quiet as the result of the damping disk 63.

What is claimed is:

1. A rotary cylinder for an epilation appliance, comprising:

at least two clamping elements arranged adjacent to each other;

a mechanism for damping noise associated with at least one of the clamping elements;

two adjacent disks having on their facing sides a clamping element receiving space, with one of said at least two clamping elements accommodated in said clamping element receiving space; and an intermediate layer arranged between one of the two adjacent disks and a respectively adjacent clamping element.

2. The rotary cylinder according to claim 1, wherein the damping mechanism comprises an intermediate layer acting as noise damping material associated with the at least two clamping elements.

3. The rotary cylinder according to claim 1, wherein the intermediate layer comprises a noise damping element and is constructed as a component of the clamping element on a side of the clamping element closest to the disk.

4. The rotary cylinder according to claim 1, wherein the intermediate layer comprises a shim.

5. The rotary cylinder according to claim 1, wherein at least one of the at least two facing clamping elements is movable, and the intermediate layer is associated with the movable clamping element.

6. The rotary cylinder according to claim 5, wherein allowance is made for a manufacturing clearance in the clamping element receiving space between the disk and the movable clamping element, and said clearance is filled by the intermediate layer.

7. The rotary cylinder according to claim 2, wherein the intermediate layer is of an elastic construction.

8. The rotary cylinder according to claim 2, wherein the intermediate layer comprises a material selected from the group consisting of papers, sand papers, plastic, and sponge rubber.

9. The rotary cylinder according to claim 1, wherein one of the at least two clamping elements has two outer laminations and at least one intermediate lamination in between.

10. The rotary cylinder according to claim 9, wherein the intermediate lamination includes a polymer.

11. The rotary cylinder according to claim 10, wherein the intermediate lamination includes an adhesive.

12. The rotary cylinder according to claim 9, wherein the outer laminations include a metal.

13. The rotary cylinder according to claim 9, wherein each of the outer laminations has a thickness that varies.

14. A rotary cylinder for an epilation appliance comprising:

at least two clamping elements arranged adjacent to each other;

two pressure pins movably mounted so as to press in alternating sequence upon at least one of the at least two clamping elements;

a control mechanism which, during use, actuates the pressure pins; and a damping disk associated with the pressure pins and which loads the pressure pins in a direction toward the associated clamping element.

15. The rotary cylinder according to claim 14, further comprising a thrust plate, wherein the two pressure pins are actuatable by the thrust plate.

16. The rotary cylinder according to claim 14, wherein the damping disk is made of a metal.

17. The rotary cylinder according to claim 14, wherein the damping disk is made of a plastics material.

18. The rotary cylinder according to claim 14, wherein the damping disk is made of a spring steel.

19. The rotary cylinder according to claim 14, wherein the damping disk is made of a flexible plastics material.

* * * * *